US007834821B2

(12) United States Patent
Sugimoto

(10) Patent No.: US 7,834,821 B2
(45) Date of Patent: Nov. 16, 2010

(54) FLUORESCENT DISPLAY DEVICE AND METHOD FOR DRIVING THE SAME

(75) Inventor: Terukazu Sugimoto, Chiba (JP)

(73) Assignee: Futaba Corporation, Chiba (JP)

( * ) Notice: Subject to any disclaimer, the term of this patent is extended or adjusted under 35 U.S.C. 154(b) by 787 days.

(21) Appl. No.: 11/745,471

(22) Filed: May 8, 2007

(65) Prior Publication Data

US 2008/0042548 A1 Feb. 21, 2008

(30) Foreign Application Priority Data

Jun. 28, 2006 (JP) ..... 2006-178119

(51) Int. Cl.
*G09G 3/20* (2006.01)

(52) U.S. Cl. ..... 345/75.1; 345/82; 345/204

(58) Field of Classification Search ..... 345/75.1, 345/102; 315/169.1, 169.3
See application file for complete search history.

(56) References Cited

U.S. PATENT DOCUMENTS 5,162,789 A * 11/1992 Moriya et al. ..... 345/75.1
6,778,169 B1 * 8/2004 Hiraga et al. ..... 345/75.1
2007/0176883 A1 * 8/2007 Hsu et al. ..... 345/102

* cited by examiner

*Primary Examiner*—Nitin Patel
(74) *Attorney, Agent, or Firm*—Edell, Shapiro & Finnan, LLC

(57) ABSTRACT

The present invention discloses a fluorescent display apparatus and a method for driving the same. In accordance with the apparatus and the method, a display data outputted from a display controller 10 is converted by and stored in a shift register 11 and a latch circuit 12. While a data outputted from gate circuits A1-Ak is set to have a blanking period and displayed by a fluorescent display 14, a second display data outputted from gate circuits Ak+1-An is provided to a selector 16 to be outputted as a control data for a second emitting means. The second data may be outputted to have a different brightness from the fluorescent display 14 by a port switching signal provided to the selector 16.

9 Claims, 7 Drawing Sheets

FLUORESCENT DISPLAY DEVICE AND METHOD FOR DRIVING THE SAME

CROSS REFERENCE TO RELATED APPLICATIONS

This application claims priority under 35 U.S.C. §119 to JP 2006-178119, filed 28 Jun. 2006 and titled "Fluorescent Display Apparatus and Method for Driving the Same", the disclosure of which is hereby incorporated by reference in its entirety.

BACKGROUND OF THE INVENTION

1. Field of the Invention

The present invention relates to a fluorescent display apparatus, and in particular to a fluorescent display apparatus and a method for driving the same capable of providing colorful displays by using a lighting or a display function of a fluorescent display and other emitting means in combination.

2. Description of Prior Art

A fluorescent display tube is an electron tube wherein an electron emitted from a cathode is impacted on a fluorescent film having a voltage applied there to in a vacuum vessel having at least one transparent side to display a character or a figure of a desired pattern. The desired pattern to be displayed is composed of a fluorescent material disposed on an anode.

A general fluorescent display apparatus comprises a glass substrate, a wiring layer for driving an anode or a grid disposed on the glass substrate, a fluorescent film disposed on the anode to have a predetermined pattern, a cathode facing the fluorescent film, the grid disposed between the fluorescent film and the cathode, and an outer glass envelop under a predetermined vacuum condition including a transparent front glass and a side wall formed along an edge thereof disposed between the glass substrate and the front glass.

The fluorescent film which constitutes a fluorescent display has various shapes according to a content to be displayed. When simple alphanumeric characters are to be displayed, a segment type covered with the fluorescent material is employed using a segment as the anode.

In addition, when the characters or the figures are to be displayed, a dot type fluorescent display tube or a graphic type fluorescent display tube is used. Generally, various shapes are displayed according to a dynamic driving wherein a display data is provided to a dot anode electrode.

However, in accordance with a recent progress in fluorescent display technology, a more complex display function is in demand such that various emitting means are simultaneously controlled to correspond to a content to be displayed by the fluorescent display apparatus as well as displaying in color, thereby providing a colorful display.

For instance, FIG. 6 illustrates an example of a fluorescent display tube capable of displaying multiple colors. The fluorescent display tube comprises a plurality of anodes 104 disposed on a surface of a glass substrate 101, a fluorescent film 105 corresponding to the plurality of anodes 104 disposed in a manner that the fluorescent film 105 is spaced apart from the plurality of anodes 104, a grid 106 and a cathode (filament) 107 disposed over the fluorescent film 105. A reference numeral 102 denotes a front glass substrate, and a reference numeral 103 denotes a side wall.

In accordance with the fluorescent display tube, a backlight source 108 is disposed behind the glass substrate 101 and the backlight source 108 comprises a light emitting diode, for instance.

The backlight source 108 of the fluorescent display tube is a surface emitting light source outputting color lights such as a red light, a green light and a yellow light. An area and a brightness of the fluorescent film 105, a position and an area of transparent area and a brightness of the backlight source 108 are determined such that a light 115 of the fluorescent film 105 on a surface of the glass substrate 101, a light 116 of the backlight source 108 passing through an aperture 104*a* of a strip-type anodes 104 disposed between the fluorescent film 105, and a light 115 of the fluorescent film 105 are mixed when observed by an observer 117.

Therefore, various display modes may be generated according to the color of the backlight source 108 thereby being capable of creating the colorful display modes.

In addition, FIG. 7 illustrates a portion of a display apparatus using a light emitting diode proposed by the applicant, wherein the light emitting diode is disposed in a vacuum vessel as a second light source.

The fluorescent display apparatus 120 is a graphic fluorescent display tube displaying the characters and figures in full color, wherein green (G) and blue (B) are displayed by an illumination of a fluorescent material, and red (R) is displayed by an illumination of the LED 100.

An outer glass envelop of the fluorescent display apparatus 120 comprises a transparent front substrate 121, a back side substrate (not shown) parallel to the front substrate 121, and a side portion (not shown) bonding an edge portion of the two substrates. A plurality of display units 122 is disposed on inner surface of the front substrate 121.

The display units 122 comprises a fluorescent display unit 123 disposed on the inner surface of the front substrate 121 and a LED display 124.

In the LED display 124, the plurality of the LEDs 100 having a predetermined distance therebetween disposed on the front side substrate 121 are aligned along a vertical direction of a display surface to form a row, and the row of the LEDs having a predetermined distance therebetween 100 is arranged in a horizontal direction to form columns.

Pluralities of row wirings 125 and column wirings 126 perpendicular to each other and a drive matrix of the LED display unit 124 are disposed on the inner surface of the front substrate 121. The row wirings and the column wirings are transparent such that the column wirings 126 have a form of a dotted line for successive strip-type row wirings 125 in order to avoid a crossing with the row wirings 125. Accordingly, each of the row wirings 125 is connected to a cathode of each of the LEDs 100, and an end portion of each of the column wirings 126 is connected to an anode of each of the LEDs 100.

In accordance with the above structure, when the row wirings 125 and the column wirings 126 are driven at an appropriate timing, a desired one of the LEDs 100 in an LED display area of the display surface may be selectively illuminated in red.

A wire-shaped control electrode 127 parallel in vertical direction is disposed over the fluorescent display 123 to have a predetermined distance therebetween, and the cathode (filament) (not shown) of strip-type is disposed over the control electrode 127. A reference numeral 130 denotes a transparent insulation layer, a reference numeral 131 denotes the anode, reference numerals 132 and 133 denote a filter and a reference numeral 134 denotes a fluorescent material layer.

The fluorescent display apparatus 120 scans the control electrode and the cathode of each of the LEDs 100 commonly connected using a common scan signal controller. The common scan signal controller provides a display signal to each of the anode 131 of the fluorescent display 123 and the anode of each of the LEDs 100 at a predetermined timing. Accordingly, the fluorescent display 123 and the LED display 124 are synchronizedly driven to display a desired image.

FIG. 8 illustrates a fluorescent display apparatus having an LED as a backlight wherein a light guide plate 141 is disposed on a front surface of the fluorescent display apparatus to produce a profound display.

A FL (fluorescent display) 142, which is a display unit, is attached to a printed circuit board 143 having a circuit thereon for controlling and operating the FL to display an information such as numbers, characters and images while self-illuminating. Specifically, the FL 142 comprises a cold cathode fluorescent tube for instance, to display character and image information of an operating mode such as a time, 'record', 'play', 'fast forward' and 'rewind'.

In accordance with the display apparatus, a light is attached in a manner that a rectangular portion of the light guide plate 141 corresponds to a display window 144 disposed at an upper portion of a front surface of a front panel, and the FL 142 is attached in a manner that the FL 142 overlaps the illuminator.

The illuminator comprises an LED 145 attached to a left side of the light guide plate 141 having a wedge-shaped cross-section from 4 mm to 1 mm which is fixed to the light guide plate 141 by holders 146*a* and 146*b*.

An illumination of the character and the image displayed in the display area of the FL 142 is recognized from outside by emitting through an area of the display window 144 having a high transmissivity.

A light of the LED 142 is emitted through the front surface for a decoration. That is, the tri-color LED 145 in the illuminator is controlled as well as the display by the self-illumination of the FL to be capable of an illumination of more than seven colors, thereby enabling a display having a whole new lighting different from a conventional liquid crystal display. Contrary to a backlight of the liquid crystal display, a display function itself is not problematic even when a brightness of the illumination of the light guide plate itself is changed due to the self-illumination of the FL.

As described above, when the second emitting means, the light emitting diode for instance, is illuminated simultaneously with the fluorescent display tube in the conventional fluorescent display apparatus, various displays may be provided. For instance, when applied to a fluorescent display apparatus of an automobile, a visibility may be added in order to improve a driving function.

In addition, when various control information of the automobile or a lighting status in the automobile is displayed via an illumination of the LED associated with the fluorescent display apparatus, a colorful display function and a pleasant space may be embodied.

Therefore, in accordance with a conventional technology, an illumination control of the emitting means other than the fluorescent display such as the LED may be simultaneously carried out based on the display data being outputted from a microcomputer of the automobile.

Moreover, while outputting a character data displayed on the fluorescent display tube or a segment selection data from a display controller simultaneously with outputting a portion of the data being outputted from the display controller for the fluorescent display tube as a diode driving signal may be considered, it is disadvantageous in that an illumination output of the LED also changed when the dimming of the fluorescent display tube is carried out.

SUMMARY OF THE INVENTION

It is an object of the present invention to provide a vacuum fluorescent display apparatus comprising an electron source disposed in a vacuum vessel, a fluorescent display emitting a light by an electron radiated from the electron source and a driver controlling circuit (display controller) outputting a display data for the fluorescent display to carry out a predetermined display based on an input data, wherein the driver controller outputs a first display data for the fluorescent display at a predetermined timing in combination with a second display data for a second emitting means having a function of a lighting or a display associated with the fluorescent display selectively using a selector.

A light emitting diode (LED) may be used as the second emitting means and a brightness of the display data for the LED being outputted via the selector is controlled independently of the fluorescent display.

The fluorescent display apparatus of the present invention is most suitable for a CIG (Chip In Glass) type fluorescent display apparatus wherein the drive controlling circuit for the display driver or a groups of drivers for providing an output of the drive controlling circuit is housed in a vacuum vessel, and the data for the second emitting means may be obtained from an external output terminal of the vacuum vessel to allow using the backlight of the fluorescent display.

Moreover, in accordance with a driving method of a fluorescent display apparatus of the present invention, since the fluorescent display is illuminated by the electron emitted from the electron source disposed in the vacuum vessel and a signal for displaying a desired character and figure is outputted, the display data for the fluorescent display and the display data of the second emitting means associated with the fluorescent display, for instance the lighting are programmed to be outputted from a one-chip microcomputer as well as a brightness of the display data for the fluorescent display and the brightness of the other emitting means for the lighting are independently controlled.

In order to achieve the above-described objects of the present invention, there is provided a vacuum fluorescent display apparatus comprising an electron source disposed in a vacuum vessel, a fluorescent display for emitting a light by an electron radiated from the electron source and a drive controlling means for outputting a display data for the fluorescent display to carry out a predetermined display based on an input data, wherein the driver controlling means at least comprises: a latch circuit for storing a first display data for the fluorescent display and a second display data for a second emitting means associated with the fluorescent display; a gate circuit for providing a blanking period for an output of the latch circuit and for controlling a dimming; and a selector for selecting and outputting one of the second display data sustained in the latch circuit and the second data being outputted from the gate circuit, wherein the second data selected by the selector is provided to the second emitting means.

There is also provided a method for driving a vacuum fluorescent display apparatus comprising illuminating a fluorescent display using an electron emitted by an electron source disposed in a vacuum vessel, and controlling a display controller disposed in the vacuum vessel in a manner that the display controller outputs a signal for displaying a desired character and figure and a signal for a second emitting means associated with the fluorescent display while controlling a brightness of a display data for the fluorescent display and a brightness of the second emitting means independently.

DETAILED DESCRIPTION OF THE PREFERRED EMBODIMENTS

Figure 1:
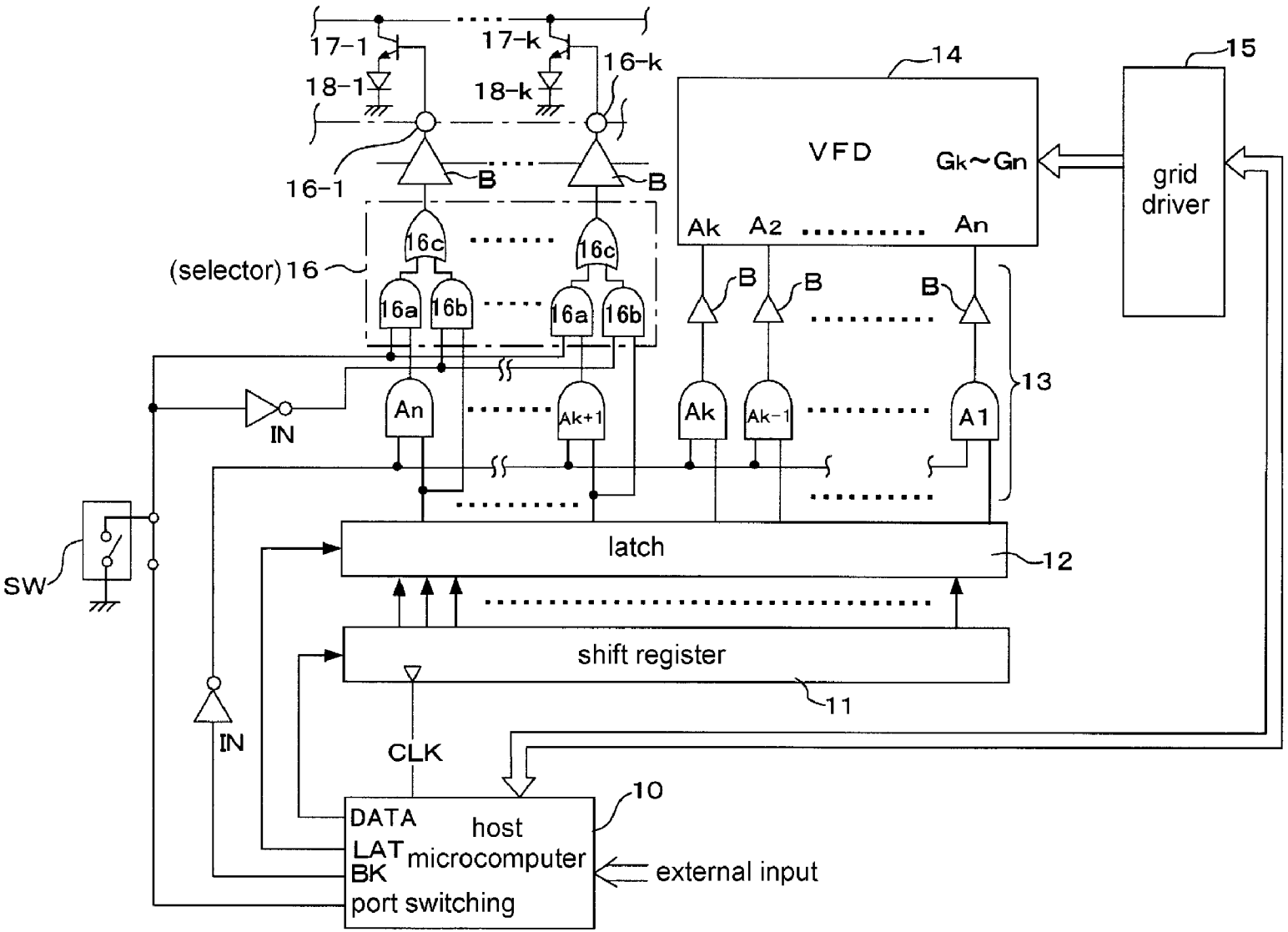
FIG. 1 is a block wiring diagram illustrating a vacuum fluorescent display apparatus in accordance with a first preferred embodiment of the present invention.

FIG. 1 illustrates a detailed example of a drive section of a vacuum fluorescent display apparatus in accordance with the present invention. In FIG. 1, a reference numeral 10 denotes a drive control circuit (hereinafter referred to as "display controller") which generally comprises a microcomputer having a digital operation processing and storing unit and a signal processor integrated therein for outputting a display data for illuminating a fluorescent display tube as a driving signal at a predetermined timing based on an externally provided command signal.

While the display controller 10 outputs various types of signals corresponding to a display driving method of the fluorescent display apparatus, the display controller 10 generally outputs a scanning signal (grid selection signal) that designates a display position of a fluorescent tube, a serial data signal including an illumination data for a plurality of illuminating anodes (segments) of the fluorescent tube, a latch signal LAT for converting the serial data into a parallel data and a blanking signal BK for selecting a display period of the illuminating segments as main signals since the display controller 10 employs a dynamic driving method.

In addition, a port switching signal for selecting an illumination mode of an LED is outputted since a portion of the display data is outputted as an LED driving signal.

A reference numeral 11 denotes a shift register wherein the display data is sequentially provided as a serial data. Since a data provided to each stage of the shift register 11 according to a timing of a clock signal CLK is outputted as a parallel signal, the parallel signal is sustained in a latch circuit 12 described below as a timing of a latch signal LAT per a predetermined period.

A reference numeral 13 denotes a driver stage for providing the display data to a fluorescent display or a second emitting means, wherein the driver stage 13 comprises gate circuits A1-An and a buffer amplifiers B. Each of the buffer amplifiers B converts a logic level to a display driving voltage level.

The display data sustained in the latch circuit 12 is provided to a display unit through the gate circuits A1-An having a blanking signal BK applied to one input thereof.

In accordance with the embodiment, the display data being outputted from the gate circuits A1-Ak constitutes a first display data corresponding to a fluorescent display unit 14, the display data being outputted from the gate circuits Ak+1-An constitutes a second display data corresponding to other light sources such as a light emitting diode.

Generally while the grid selection signal is provided to the fluorescent display 14 through a grid driver 15 for a scan of a displayed content, the fluorescent display 14 is dynamically controlled.

However, the embodiment is characterized in that the second display data being outputted from the gate circuits Ak+1-An are provided to the buffer amplifiers B through a selector 16 surrounded by a dotted line.

That is, the second display data without a blanking control being outputted from the latch circuit 12 and the second display data under the blanking control by the gate circuit Ak+1-An are applied to a first input of logic circuits 16*a* and 16*b* of the selector 16, respectively, and a port switching signal having a logic level of H or L is inputted to one of the logic circuits via an inverter IN such that the second display data without the blanking control and the second display data under the blanking control may be selectively outputted from a logic circuit 16*c*.

Therefore, the second display data being outputted from the selector 16 is provided to base electrode of driving transistors 17-1, 17-2, . . . through the buffer amplifiers B to drive emitting elements 18-1, 18-2, . . . when the emitting means is an LED.

Figure 2:
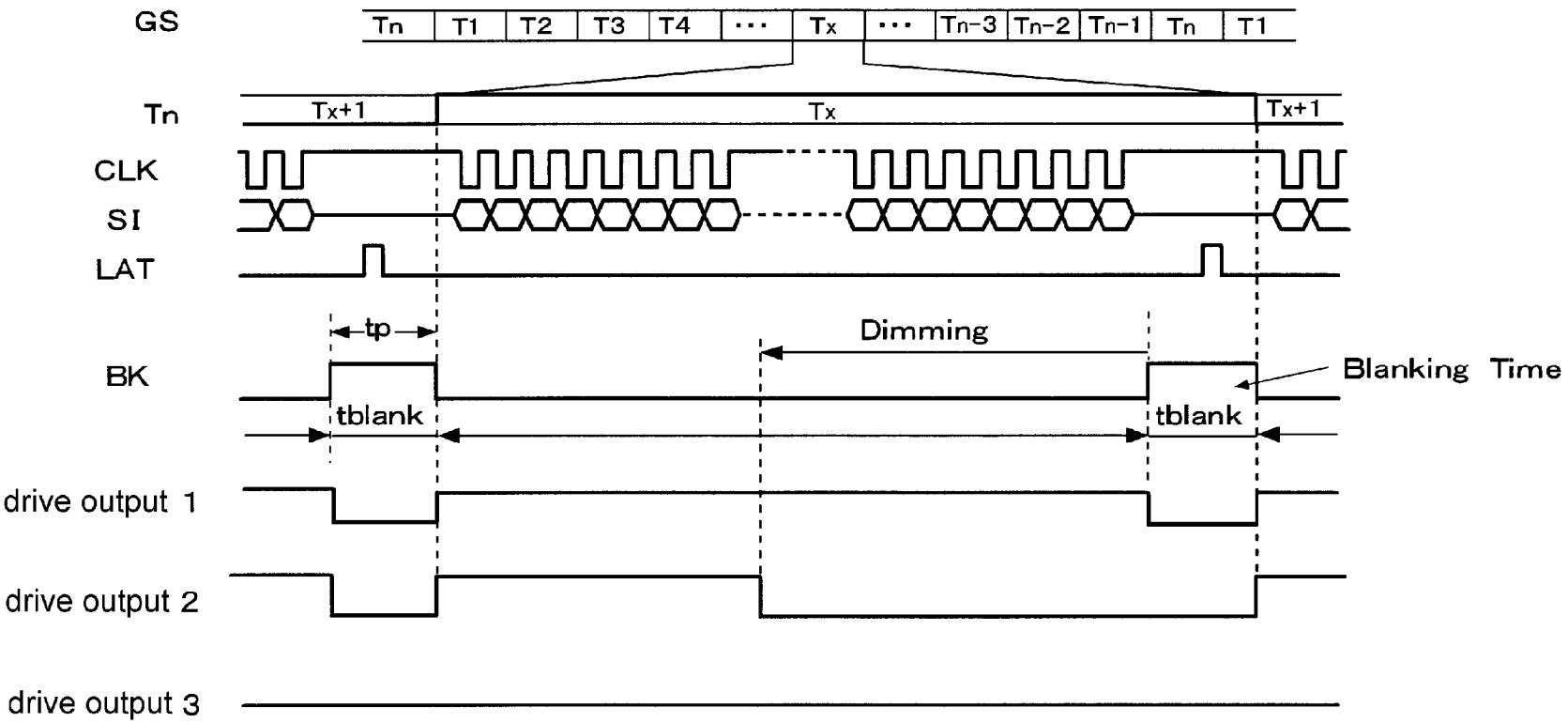
FIG. 2 is a timing waveform diagram illustrating various signals of a display controller.

FIG. 2 illustrates a timing wherein the display data is outputted as a driving signal.

In FIG. 2 GS denoting a period T of a grid scan signal that represents a scan period of the display unit, Tn denoting an enlarged view of the period Tx of the grid scan signal, a serial data SI within the period, the clock signal CLK, the latch signal LAT for inputting the serial data SI to the latch circuit 12 and a blanking signal BK that generates a timing for moving to a next period are shown.

As described above, since the display data latched within the scan period T is outputted through the gate circuit A1-An having the blanking signal BK as the first input, the drive signal being outputted from the buffer amplifiers B for driving is outputted during a drive output 1 being outputted.

Therefore, since a brightness of the drive output 1 is always limited by a pulse width tp of the blanking signal BK, the drive output 1 is limited to have a short output width shown as a drive output 2 when the pulse width of the blanking signal BK is widened for dimming as shown by an arrow, thereby controlling the dimming by varying the width of the blanking signal.

Accordingly, in accordance with conventional art, a brightness of the LED being outputted to an external terminal is affected by the control of the dimming, thereby damaging a display function.

However, in accordance with the preferred embodiment of the present invention, the second display data provided to the LED is outputted to external terminals 16-1, 16-2, . . . through the selector 16. For instance, in accordance with the embodiment shown in FIG. 1, when a level of the port switching signal is set to zero (level L), the second display data being outputted from the selector 16 is a signal being outputted through the logic circuit 16*b*, whereby a signal that is not affected by the blanking signal BK from the latch circuit 12 as the second display data (driver output 3) for driving the LED which is the second emitting means.

In accordance with embodiment, when a switch SW is installed, the port switching signal may be set to 'H' or 'L' in advance.

That is, when the switch SW is embodied by a jumper cable on the printed circuit board, whether the dimming has an effect on the display data of the second emitting means for each type of the fluorescent display apparatus may be selected in advance.

Figure 3:
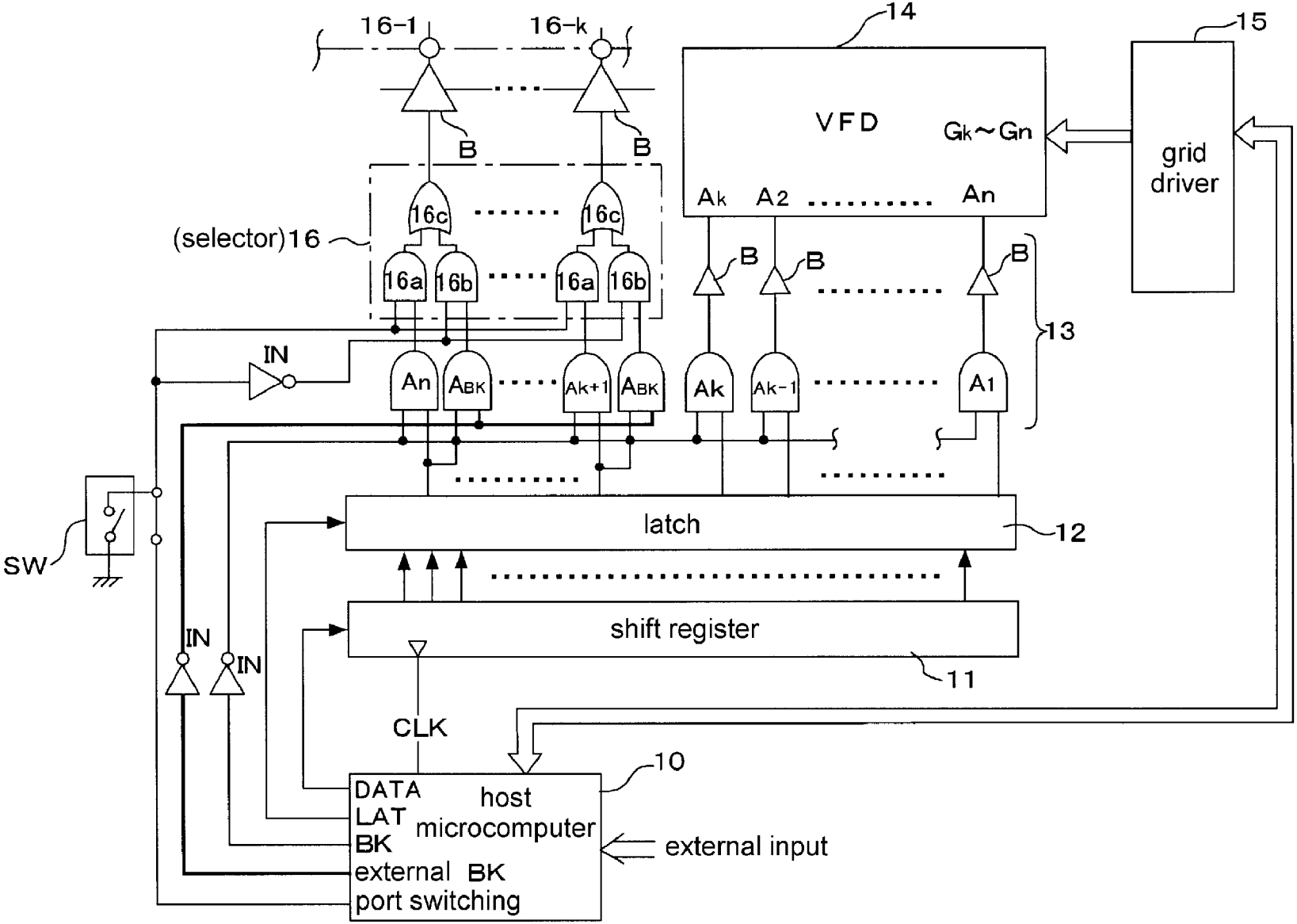
FIG. 3 is a block wiring diagram illustrating a vacuum fluorescent display apparatus in accordance with another preferred embodiment of FIG. 1.

FIG. 3 illustrates another embodiment of the present invention, wherein like reference numerals in the accompanied drawings refer to like elements of FIG. 1.

That is, a reference numeral 10 denotes a display controller comprising a microcomputer having a digital operation processing and storing unit and a signal processor integrated therein for outputting a display data for illuminating a fluorescent display as a driving signal at a predetermined timing.

Since the display controller 10 employs a dynamic driving method, the display controller 10 outputs a scanning signal (grid selection signal) that designates a display position of a fluorescent tube, a serial data signal including an illumination data for a plurality of illuminating anodes (segments) of the fluorescent tube, a latch signal LAT for converting the serial data into a parallel data and a blanking signal BK for selecting a display period of the illuminating segments as main signals.

In accordance with the embodiment, while a port switching signal for designating an illumination port is set to be outputted in order for a portion of a display data is outputted as a LED driving signal, the external BK signal for controlling an illumination of an external emitting means is being outputted from the display controller 10.

A reference numeral 11 denotes a shift register, and a reference numeral 12 denotes a latch circuit 12 for receiving a data of each stage of the shift register 11 as a timing of the latch signal LAT per one scan.

A reference numeral 13 denotes a driver stage comprising gate circuits A1-An and buffer amplifiers B wherein the buffer amplifiers B convert a logic level to a display driving voltage level.

The display data sustained in the latch circuit 12 is provided to a display unit through the gate circuits A1-An having a blanking signal BK applied to one input thereof.

In accordance with the embodiment, a first display data being outputted from the gate circuits A1-Ak corresponds to a fluorescent display 14, and a data being outputted from the gate circuits Ak+1-An is a second display data for being outputted to a second other emitting means, a light emitting diode for instance, which is provided to external terminals 16-1, 16-2, . . . **16-*k***.

Since the fluorescent display unit 14 scans display content, a dynamic driving thereof wherein the grid selection signal is provided through a grid driver 15 is carried out.

In accordance with the embodiment, while the second display data being outputted from the gate circuits Ak+1-An is provided to the buffer amplifiers B through a selector 16 surrounded by a dotted line, a signal provided through the gate circuit AbK outputting a logical product of an output data of the latch circuit 12 and an external BK signal is provided as the second display data to the selector 16.

That is, the display data under the blanking control by the gate circuits Ak+1-An and the display data under an external blanking control in the gate circuit AbK are inputted to a first input of logic circuits **16*a* and 16*b*, respectively, and the port switching signal is inputted to one of the logic circuits such that the second display data under the blanking control and the second display data under the external blanking control may be selectively outputted from a logic circuit 16*c***.

Figure 4:
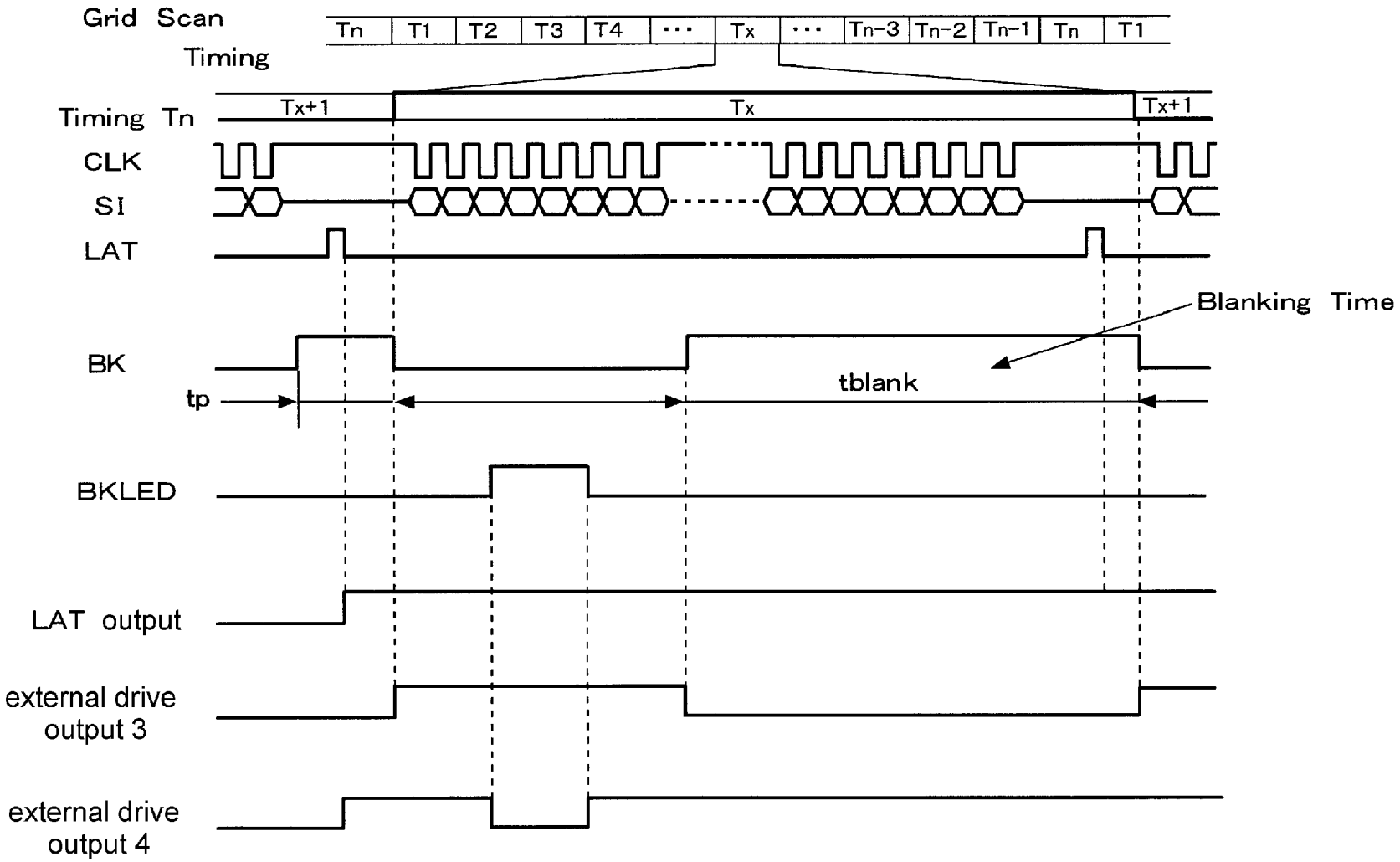
FIG. 4 is a timing waveform diagram illustrating various signals of a display controller of FIG. 3.

Therefore, in accordance with embodiment shown in FIG. 3, an external blanking signal BKLED is provided for a serial data SI, a clock signal CLK, a blanking signal BK of the fluorescent display unit as shown in FIG. 4.

Accordingly, one of an external drive output 3 which is the second display data having the dimming thereof adjusted to be identical to the first display data of the fluorescent display 14 having the blanking time adjusted by the blanking signal BK and an external drive output 4 which is stopped during the external blanking signal BKLED for the latched second display data and has a brightness thereof independently adjusted for the emitting means such as the LED may be selected and outputted.

In such case, when a pulse width of the external blanking signal BKLED is set to zero, the second display data sustained in the latch circuit 12 is outputted (the drive output 3 of FIG. 2) without the dimming.

Figure 5:
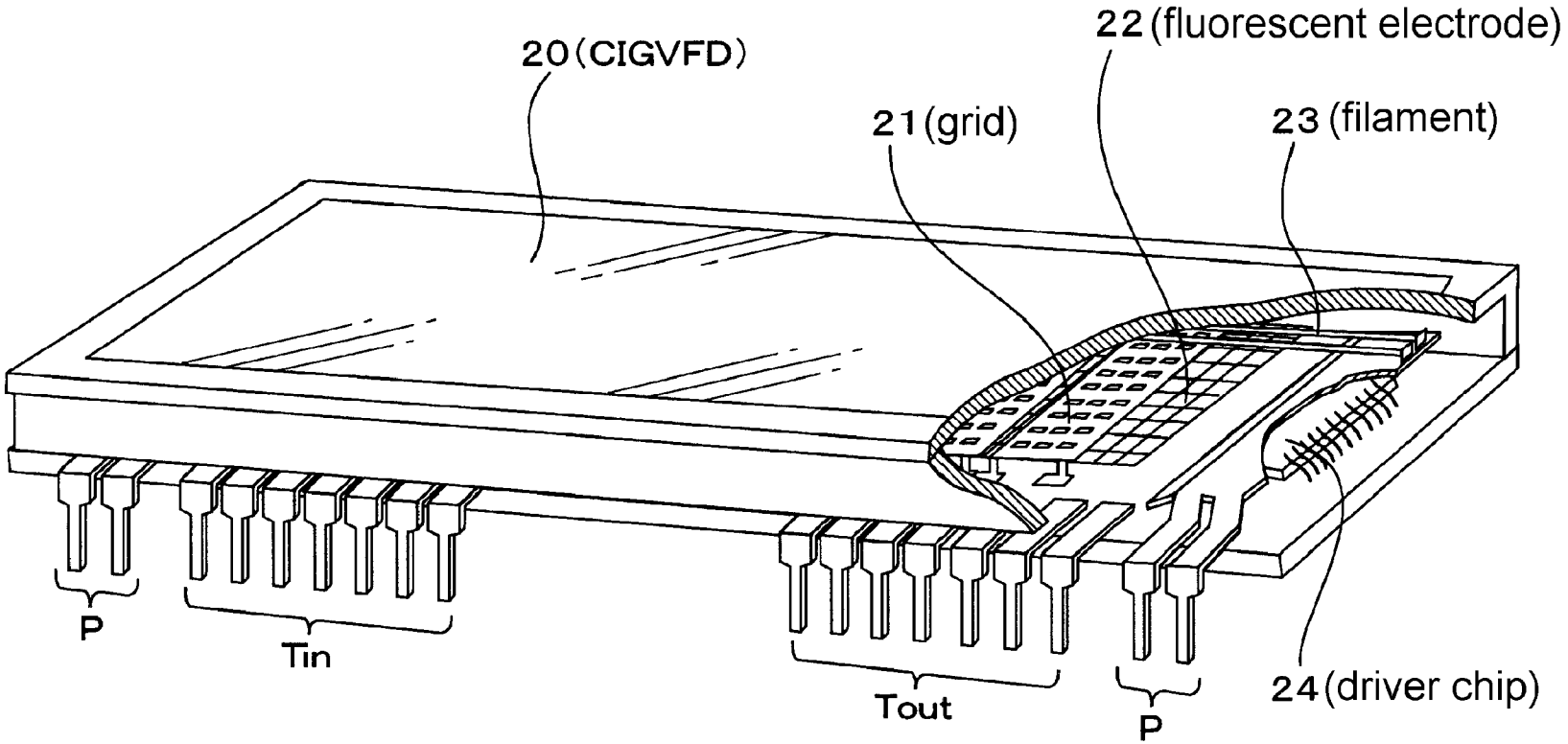
FIG. 5 is a perspective view exemplifying a vacuum fluorescent display tube.
Figure 6:
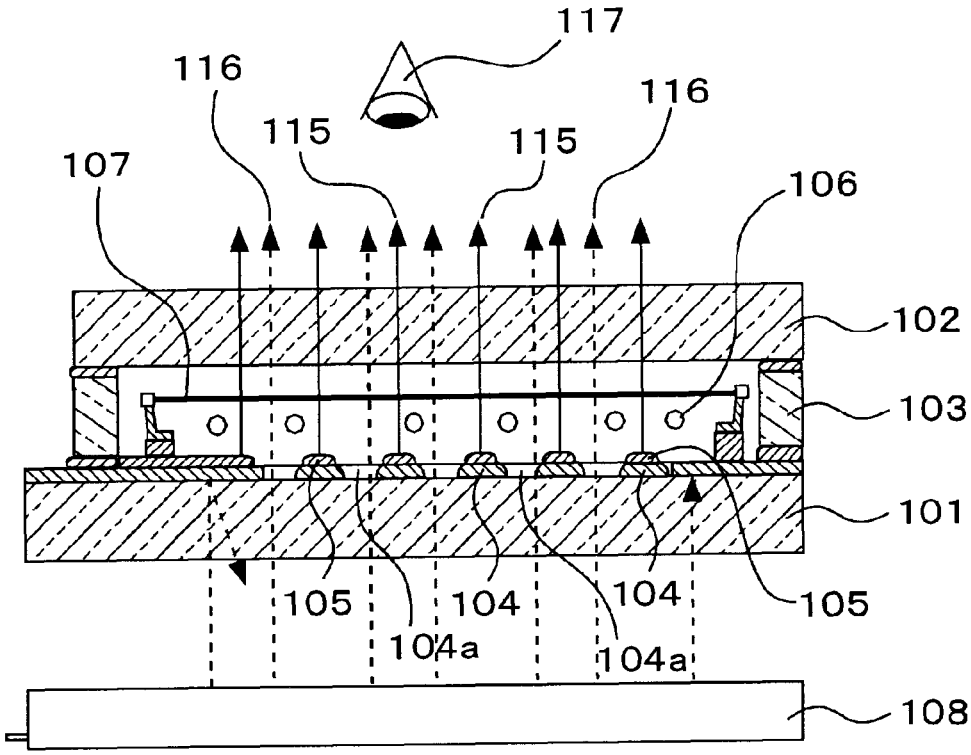
FIG. 6 is a cross-sectional view illustrating a conventional vacuum fluorescent display tube.
Figure 7:
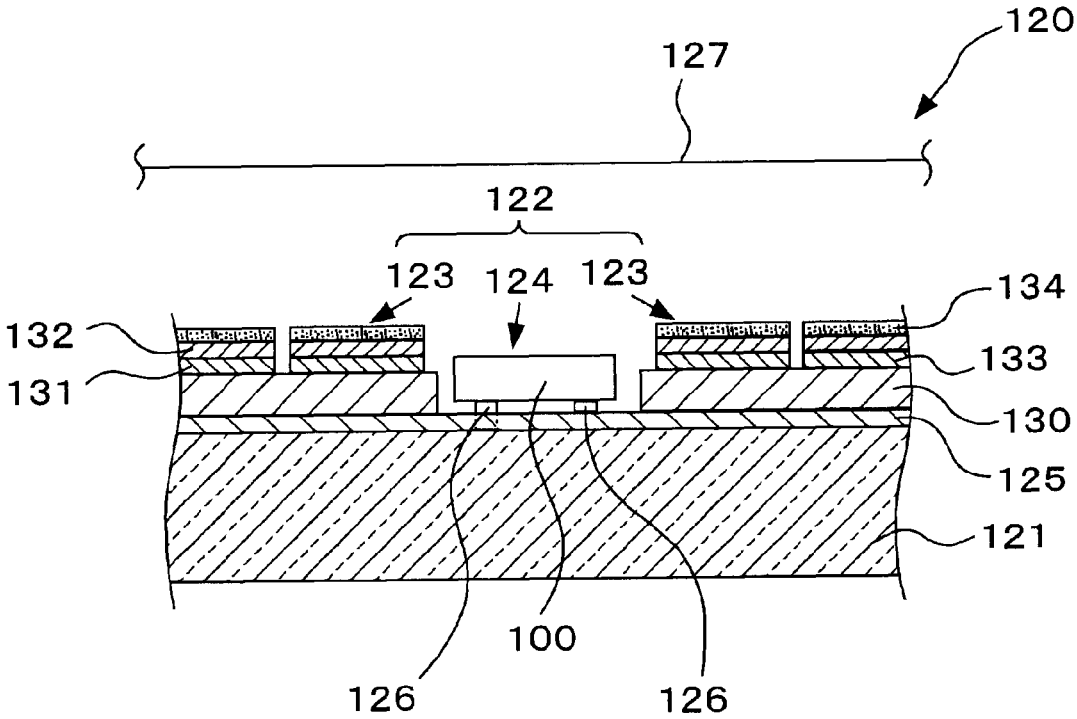
FIG. 7 is a schematic diagram illustrating a vacuum fluorescent display apparatus having a backlight light source.
Figure 8:
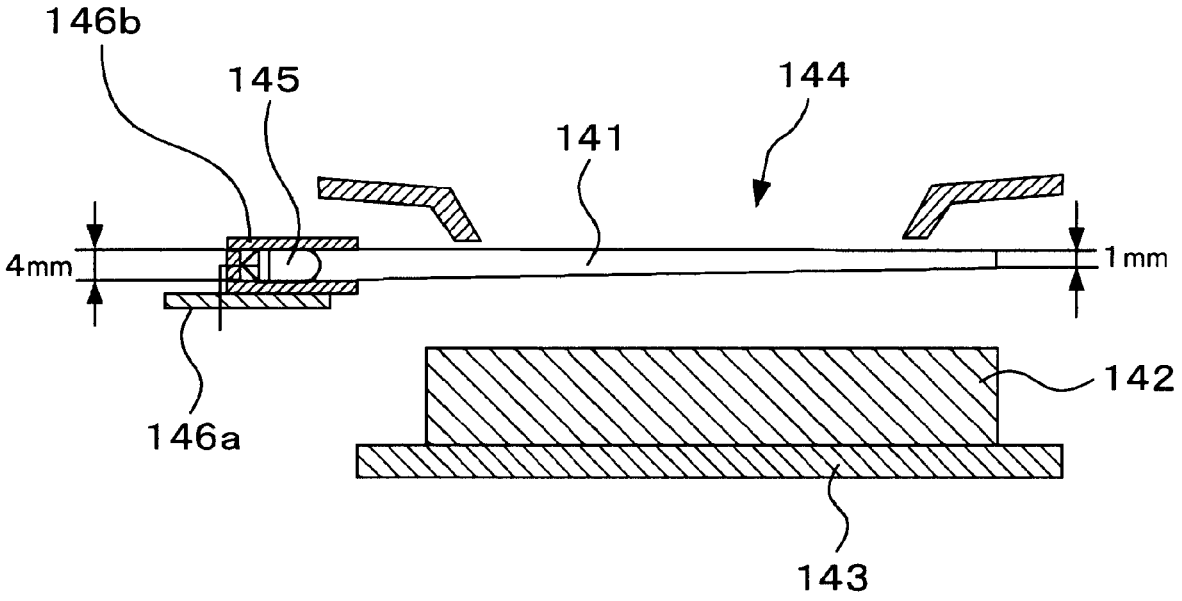
FIG. 8 is a cross-sectional view illustrating a vacuum fluorescent display apparatus of a front illumination type.

FIG. 5 illustrates a detailed example of an apparatus having a driving method of the fluorescent display apparatus applied there to in accordance with the present invention. As shown, the example illustrates a CIG (Chip In Glass) type vacuum fluorescent display (CIGVFD) 20 having the display controller 10, a chip 24 of a drive stage 13 housed in a flat glass vessel wherein a grid 21 which is a scan electrode, a dot-shaped fluorescent electrode 22 arranged in a matrix form to have rows and columns, and a filament 23 are formed therein.

A plurality of power terminals p, an input terminal Tin for driving the display extend from a side wall of the vacuum vessel by a lead terminal, and as described above, an external lead terminal Tout for driving the fluorescent display and the LED which is the second emitting means may be obtained from the lead terminal of the sidewall.

Therefore, when the CIG type vacuum fluorescent display is mounted on a front board of an automobile, a light source such as an LED for a display attached to the front board may be simultaneously controlled by a command signal inputted to the display controller.

In addition, an illumination control of the LED without affecting a brightness control of the fluorescent display is achieved, thereby being capable of the independent dimming control for the LED for the backlight associated with the fluorescent display as described in the conventional art or the LED used for other functional displays of the automobile.

Moreover, when the driving method of the present invention is applied to a module type fluorescent display apparatus wherein a fluorescent display tube is attached to a wiring plate, the fluorescent display tube and an LED display may be controlled independently of the brightness by a single display controller.

As described above, the present invention is advantageous in that the colorful display function may be embodied by driving the fluorescent display tube and the second emitting means.

Moreover, in accordance with the fluorescent display apparatus and the method for driving the same of the present invention, the colorful display is provided by preventing the effect of the brightness of the second emitting means on the brightness of the fluorescent display apparatus even when an one-chip the fluorescent tube display driver is used.

I claim:

1. A vacuum fluorescent display apparatus comprising an electron source disposed in a vacuum vessel, a fluorescent display for emitting a light by an electron radiated from the electron source and a drive controlling means for outputting a display data for the fluorescent display to carry out a predetermined display based on an input data, wherein the driver controlling means at least comprises:

a latch circuit for storing a first display data for the fluorescent display and a second display data for a second emitting means associated with the fluorescent display;

a gate circuit for providing a blanking period for an output of the latch circuit and for controlling a dimming; and a selector for selecting and outputting one of the second display data sustained in the latch circuit and the second data being outputted from the gate circuit, wherein the second data selected by the selector is provided to the second emitting means.

2. The apparatus in accordance with claim 1, wherein the second emitting means comprises a light emitting diode.

3. The apparatus in accordance with claim 1, wherein a brightness of the second display data for the second emitting means selected and outputted by the selector is independently controlled from the fluorescent display.

4. The apparatus in accordance with one of claim 1, wherein the data for the second emitting means is obtained from an external output terminal of the vacuum vessel.

5. The apparatus in accordance with claim 1, wherein the second emitting means is a backlight of the fluorescent display.

6. The apparatus in accordance with claim 1, wherein the emitting means is disposed within the vacuum vessel of the vacuum fluorescent display apparatus.

7. A method for driving a vacuum fluorescent display apparatus comprising illuminating a fluorescent display using an electron emitted by an electron source disposed in a vacuum vessel, and controlling a display controller disposed in the vacuum vessel in a manner that the display controller outputs a signal for displaying a desired character and figure and a signal for a second emitting means associated with the fluorescent display while controlling a brightness of a display data for the fluorescent display and a brightness of the second emitting means independently.

8. The method in accordance with claim 7, wherein the emitting means comprises a light emitting diode.

9. The apparatus in accordance with claim 7, wherein the emitting means is a backlight of the fluorescent display.

* * * * *